United States Patent [19]

Okano

[11] 4,113,474

[45] Sep. 12, 1978

[54] COPPER ALLOYS OF EXCELLENT CORROSION RESISTANCE, MOLDABILITY AND WORKABILITY

[75] Inventor: Masao Okano, Suwa, Japan

[73] Assignee: Toyo Valve Company, Ltd., Tokyo, Japan

[21] Appl. No.: 698,800

[22] Filed: Jun. 23, 1976

[30] Foreign Application Priority Data

Sep. 12, 1974 [JP] Japan ..... 49-105233

[51] Int. Cl.[2] ..... C22C 9/04

[52] U.S. Cl. ..... 75/156.5; 75/157.5

[58] Field of Search ..... 75/156.5, 157.5, 153, 75/154, 157

[56] References Cited

U.S. PATENT DOCUMENTS

| | | | |
|---|---|---|---|
| 2,003,685 | 6/1935 | Freeman | 75/157.5 |
| 2,118,688 | 5/1938 | Webster | 75/157.5 |
| 2,369,813 | 2/1945 | Wilkins | 75/157.5 |
| 3,713,814 | 1/1973 | Larsson | 75/156.5 |
| 3,773,504 | 11/1973 | Niimi et al. | 75/157.5 |
| 3,900,349 | 8/1975 | Costas | 75/157.5 X |
| 3,923,500 | 12/1975 | Kitazawa et al. | 75/156.5 |
| 3,963,526 | 6/1976 | Lunn | 75/157.5 X |
| 3,976,478 | 8/1976 | Okano | 75/156.5 |

FOREIGN PATENT DOCUMENTS

| | | | |
|---|---|---|---|
| 587,669 | 11/1959 | Canada | 75/157.5 |
| 198,579 | 9/1965 | Sweden | 75/157.5 |
| 975,784 | 11/1964 | United Kingdom | 75/157.5 |

*Primary Examiner*—L. Dewayne Rutledge
*Assistant Examiner*—Peter K. Skiff
*Attorney, Agent, or Firm*—Armstrong, Nikaido, Marmelstein & Kubovcik

[57] ABSTRACT

Copper alloys which excel in corrosion resistance, moldability and workability and are particularly suitable for use as materials for valves, cocks, elbows, tees, etc. or cast parts associated therewith. One copper alloy comprising by weight 27.0 - 32.0% zinc, 0.8 - 4.0% lead, 0.2 - 0.8% silicon, 0.1 - 2.0% manganese, 0.01 - 0.1% arsenic and 0.03 - 0.4% aluminum the rest being composed of copper; and the other copper alloy comprising by weight 27.0 - 32.0% zinc, 0.8 - 4.0% lead, 0.2 - 0.8% silicon, 0.1 - 2.0 manganese, 0.01 - 0.1% arsenic, 0.03 - 0.4% aluminum and 0.01 - 1.0% tin the rest being composed of copper.

3 Claims, 1 Drawing Figure

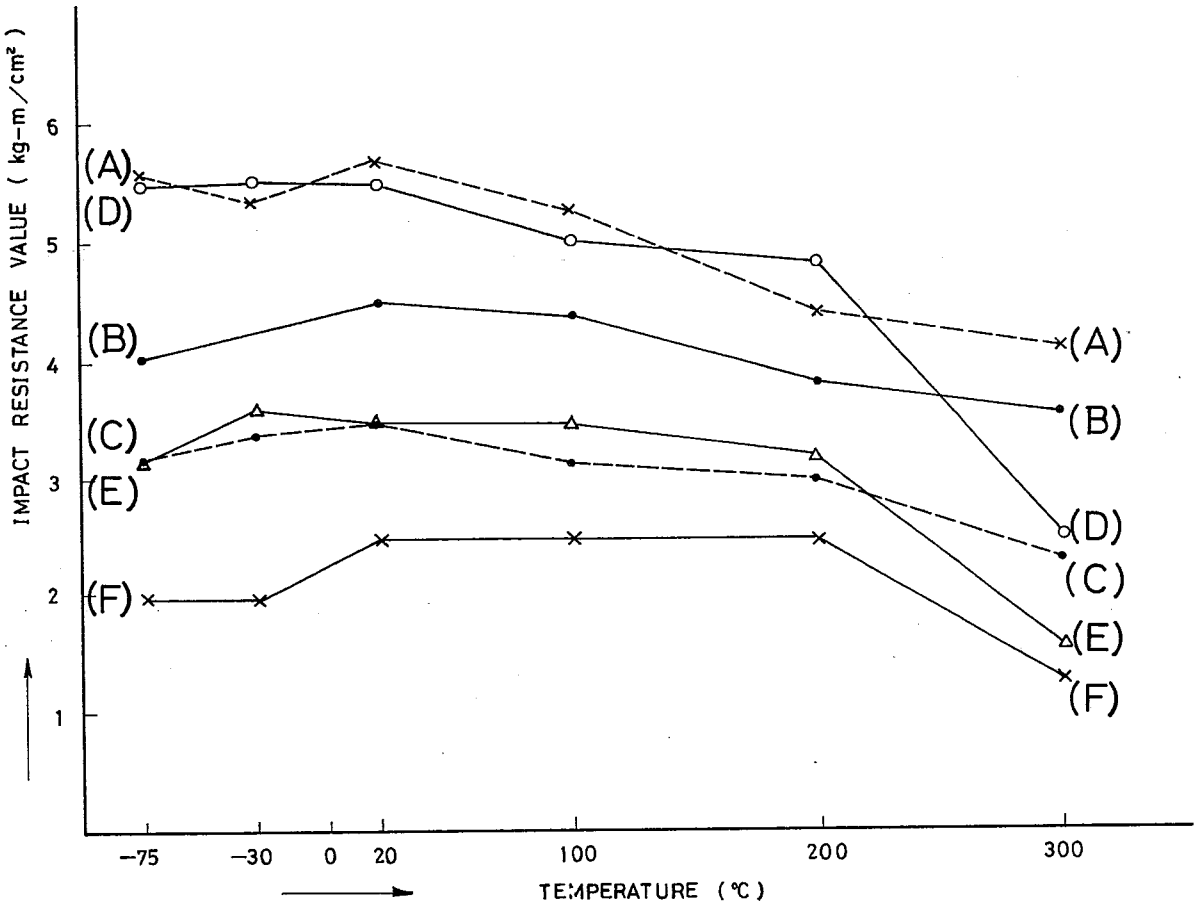
IMPACT RESISTANCE VALUE ( kg-m/cm² )
6
5
4
3
2
1
(A)
(D)
(B)
(C)
(E)
(F)
-75
-30
0
20
100
200
300
TEMPERATURE (°C)

COPPER ALLOYS OF EXCELLENT CORROSION RESISTANCE, MOLDABILITY AND WORKABILITY

BRIEF DESCRIPTION OF DRAWING

The Accompanying drawing illustrates the impact resistance value-to-temperature relation of the invented alloys in comparison with that of comparison alloys.

DETAILED DESCRIPTION OF THE INVENTION

This invention relates to copper alloys which excel in corrosion resistance, moldability and workability and more particularly to copper alloys which are principally composed of copper and zinc with lead, silicon, aluminum, manganese and arsenic added thereto for improved corrosion resistance, moldability and workability.

Demands for controlling and processing highly corrosive fluids such as industrial waste water, contaminated sea water, etc. have increased in these days. In many cases, such contaminated water contains sulfides and the like. Therefore, valves cocks and their cast accessories which have hitherto been made from the conventional moldable and workable copper alloys, such as high strength brass and the like have very short life expectancy with troubles frequently caused by dezincing, penetrant pitting and corrosion cracking.

Aluminum bronze and the like that are conventionally known as anticorrosive copper alloys have hitherto presented a problem in terms of castability and machinability. Although they can be used for the manufacture of things of relatively simple shapes such as machine parts, propellers, etc., they tend to present problems in the manufacture of things of complex shapes such as valves, cocks, etc. As for brass castings, brass, high strength brass, aluminum bronze, etc. are not sufficiently qualified in terms of corrosion resistance and machinability and are disqualified because of dezincing corrosion or aluminum removing corrosion that tends to take place in such castings.

It is therefore a general object of this invention to provide a copper alloy which excels in castability, forgeability and machinability as well as corrosion resistance and is suitable for the manufacture of corrosion resistant valves, cocks and their cast accessories such as elbows, tees and the like.

Comparing the conventional copper alloys referred to in the foregoing with the copper alloy prepared in accordance with this invention in terms of microscopic structure, the conventional alloys present an $\alpha + \beta$ phase while the copper alloy of this invention presents a pure $\beta$ phase wherein there appears no $\beta$ phase that causes the dezincing phenomenon (or aluminum removing phenomenon) which takes place in the initial stage of copper alloy corrosion.

The mechanical properties (tensile strength, elongation, yield strength compression resistance, etc.) of the alloys prepared in accordance with this invention show improvement and are higher by 30 to 40% than class 6 of JIS bronze castings; while their castability and machinability remain about the same as those of the conventional alloys. As for their corrosion resistance, they show a far lesser dezincing degree than castings made of high strength brass.

The effect of addition of elements and the reasons for limiting the ranges of their contents will be understood from the following description.

Zinc: 27.0–32.0 wt % Zinc, together with copper, is a principal component of the alloys of the present invention. However, use of it in quantity less than 27% tends to cause a decrease in the tensile strength while the elongation of the alloy increases due to such. Then, with zinc content exceeding 32 wt %, a $\beta$ phase tends to arise in the $\alpha$ phase which is a feature of the invented alloy. Therefore, the zinc content of the alloy is limited to 27.0–32 wt %.

Lead: 0.8–4.0 wt % Lead serves to increase the machinability and compression resistance of the copper alloy of this invention. However when addition of lead is made in quantity less than 0.8%, sufficient improvement cannot be attained in machinability; while, when it is added in quantity exceeding 4.0 wt %, the impact resistance of the alloy decreases and, also, segregation tends to take place. The upper limit is thus set at 4.0%.

Silicon: 0.2–0.8 wt % Silicon is an element which principally serves to improve the corrosion resistance and mechanical properties of the invented alloy. However, the addition of silicon in quantity less than 0.2 wt % is insufficient in attaining such effect in terms of tensile strength and yield strength through it serves to increase elongation. On the other hand, the addition of it in quantity exceeding 0.8 wt % tends to produce a $\beta$ phase and makes the alloy less resistive against corrosion and also results in decreased elongation. Thus, the upper limit is set at 0.8 wt %.

Manganese 0.1–2.0 wt % Addition of manganese results in micronization of the texture and improvement in the mechanical properties of the invented alloys. In order to attain such effect of addition, manganese must be added in quantity at least 0.1 wt %. However, the addition of magnanese more than 2.0 wt % results in the generation of a slag of oxides in an increased amount. The upper limit to the addition is therefore set at 2.0 wt %.

Arsenic: 0.01–0.1 wt % Arsenic is an important element for improvement in corrosion resistance of the invented alloys and particularly for inhibiting dezincing corrosion. To attain such effect of addition to a sufficient degree, arsenic must be added at least 0.1 wt %; while the addition of it in excess of 0.1 wt % does not give much further improvement in such effect. Hence, in consideration of economy in the use of the material, the upper limit is set at 0.1 wt %.

Aluminum: 0.03–0.4 wt % Aluminum is an element which serves to improve the castability of the invented alloys. The effect of addition, however, cannot be attained to a sufficient degree with aluminum added in quantity less than 0.03 wt %, besides such insufficient addition tends to cause mis-run in casting. On the other hand, if the addition is made in excess of 0.4 wt %, a $\beta$ phase tends to appear in the $\alpha$ phase by which the invented alloys are characterized. The upper limit to the addition of aluminum is thus set at 0.4 wt %.

Tin: 0.01–1.0 wt % Tin is an element which is inevitably found mixed in small quantity in cases where the invented alloy is to be manufactured using return materials of brass, etc. When such materials contain tin more than 0.01%, the tin content serves to increase the hardness and strength of the alloy. However, when the tin content exceeds 1.0 wt %, the toughness of the alloy decreases. Also, the most important effect attainable with addition of tin is inhibition of dezincing corrosion.

However addition of tin in excess of the degree of the solid solution would greatly make the alloy brittle. Therefore, the upper limit to such content is set at 1.0 wt %.

The advantages and effects of the invented alloys will become more manifest from the following description of embodiments taken in conjunction with the accompanying drawing, wherein:

A graph is provided representing the impact resistance versus temperature relations of the alloys prepared in accordance with this invention in comparison with those of other alloys, the temperature being indicated in ° C. and the impact resistance in kg-m/cm$^2$. In the drawing, the curves A, B and C represent the invented alloy Samples No. 33, 28 and 32 while the curves D, E and F represent comparison alloy samples No. 31 (HBsB), No. 30 (BsBF) and No. 29 (BC-6) respectively.

| | |
|---|---|
| I. Embodiment Examples: | Sample No. 1, 2, 4, 5, 8, 9, 10, 11, 12, 13, 16, 17, 18, 19, 21 and 22 |
| Comparison Examples: | Sample No. 3, 6, 7, 14, 15, 20 and 23 |

chemical composition, tensile strength, elongation, yield strength and hardness.

All of the sample alloys of the examples shown in Table 1 were prepared in the form of JIS A test pieces at a pouring (or casting) temperature of 1060° C. and then were machined into No. 4 test pieces before tests.

Samples No. 1, 2 and 3 were used for comparison with respect to variation in the zinc content. Samples 1 and 2 represent the invented alloy examples while Sample 3 represents an example wherein the amount of zinc is greater than the invented alloys. The comparison does not indicate much difference in mechanical properties. It, however, indicates appearance of a $\beta$ phase.

Samples No. 4, 5 and 6 are for comparison with respect to variation in the lead content, Samples 4 and 5 representing the invented alloy examples and 6 a comparison example. According to the comparison, the tensile strength, elongation and yield strength tend to lower when the addition of lead exceeds the upper limit.

Samples 7, 8, 9 and 10 are for comparison with respect to variation of the silicon content, Sample 7 representing a comparison example and Samples 8, 9 and 10 the invented alloy examples respectively. When the addition quantity of silicon is less than the lower limit as in the case of Sample 7, the tensile strength and yield Table 1.

| Sample No. | Examples | Chemical components, wt % | | | | | | | | Impurities |
|---|---|---|---|---|---|---|---|---|---|---|
| | | Cu | Zn | Pb | Si | Mn | As | Al | Sn | |
| 1 | Embodi't | Rest | 27.0 | 2.07 | 0.41 | 1.86 | 0.10 | 0.31 | | 0.09 |
| 2 | " | " | 31.40 | 2.07 | 0.41 | 1.86 | 0.10 | 0.31 | | 0.07 |
| 3 | Comp'n | " | 32.70 | 2.07 | 0.41 | 1.86 | 0.10 | 0.31 | | 0.09 |
| 4 | Embodi't | " | 32.00 | 1.00 | 0.37 | 1.00 | 0.10 | 0.33 | | 0.14 |
| 5 | " | " | 31.56 | 2.00 | 0.37 | 1.00 | 0.10 | 0.33 | | 0.15 |
| 6 | Comp'n | " | 30.62 | 4.02 | 0.37 | 0.92 | 0.10 | 0.33 | | 0.10 |
| 7 | " | " | 30.70 | 2.43 | 0 | 2.00 | 0.05 | 0.45 | | 0.11 |
| 8 | Embodi't | " | 30.51 | 2.51 | 0.21 | 2.02 | 0.09 | 0.11 | | 0.11 |
| 9 | " | " | 30.30 | 2.51 | 0.42 | 2.02 | 0.09 | 0.11 | | 0.07 |
| 10 | " | " | 29.92 | 2.51 | 0.80 | 2.02 | 0.09 | 0.11 | | 0.07 |
| 11 | " | " | 30.72 | 2.30 | 0.78 | 0.10 | 0.06 | 0.03 | | 0.10 |
| 12 | " | " | 30.30 | 2.30 | 0.78 | 0.42 | 0.06 | 0.03 | | 0.09 |
| 13 | " | " | 29.46 | 2.30 | 0.78 | 1.26 | 0.06 | 0.03 | | 0.08 |
| 14 | Comp'n | " | 27.92 | 2.30 | 0.78 | 2.80 | 0.06 | 0.03 | | 0.07 |
| 15 | " | " | 27.22 | 2.24 | 0.87 | 0.75 | 0.06 | 0.03 | | 0.09 |
| 16 | Embodi't | " | 30.48 | 2.17 | 0.75 | 0.70 | 0.01 | 0.03 | | 0.09 |
| 17 | Comp'n | " | 30.59 | 2.06 | 0.74 | 0.69 | 0.086 | 0.03 | | 0.10 |
| 18 | " | " | 30.96 | 2.45 | 0.47 | 1.68 | 0.06 | 0.14 | | 0.14 |
| 19 | " | " | 30.75 | 2.45 | 0.47 | 1.68 | 0.06 | 0.35 | | 0.12 |
| 20 | Comp'n | " | 30.59 | 2.45 | 0.47 | 1.68 | 0.06 | 0.51 | | 0.10 |
| 21 | Embodi't | " | 30.12 | 2.48 | 0.46 | 2.00 | 0.01 | 0.33 | 0.23 | 0.12 |
| 22 | " | " | 29.74 | 2.48 | 0.46 | 2.00 | 0.01 | 0.33 | 0.61 | 0.11 |
| 23 | Comp'n | " | 29.30 | 2.48 | 0.46 | 2.00 | 0.01 | 0.33 | 1.05 | 0.13 |

| Sample No. | Examples | Mechanical properties | | | |
|---|---|---|---|---|---|
| | | Tensile str'gth (kg/mm$^2$) | Elongation (%) | Yield str'gth (kg/mm$^2$) | Hardness (HB) |
| 1 | Embodi't | 32.3 | 22.5 | 14.1 | 82.6 |
| 2 | " | 32.9 | 23.0 | 13.9 | 82.6 |
| 3 | Comp'n | 36.5 | 23.5 | 15.3 | 87.2 |
| 4 | Embod't | 33.6 | 25.0 | 14.3 | 83.7 |
| 5 | " | 33.7 | 27.5 | 14.1 | 78.2 |
| 6 | Comp'n | 32.3 | 26.0 | 13.5 | 77.2 |
| 7 | " | 28.8 | 51.0 | 8.7 | 82.6 |
| 8 | Embodi't | 30.6 | 33.0 | 12.1 | 67.6 |
| 9 | " | 30.0 | 19.2 | 12.9 | 66.2 |
| 10 | " | 34.6 | 16.0 | 14.8 | 97.8 |
| 11 | " | 32.0 | 39.0 | 10.5 | 89.8 |
| 12 | " | 35.9 | 30.0 | 11.2 | 97.8 |
| 13 | " | 36.8 | 21.5 | 13.4 | 97.0 |
| 14 | Comp'n | 30.7 | 11.0 | 14.1 | 101.0 |
| 15 | " | 28.4 | 24.5 | 14.3 | 101 |
| 16 | Embodi't | 35.4 | 26.0 | 14.1 | |
| 17 | Comp'n | 30.3 | 29.0 | 13.0 | |
| 18 | " | 32.0 | 23.0 | 13.6 | 80.4 |
| 19 | " | 33.8 | 27.0 | 14.0 | 82.6 |
| 20 | Comp'n | 36.9 | 25.0 | 15.2 | 89.8 |
| 21 | Embodi't | 30.9 | 19.0 | 14.2 | 83.6 |
| 22 | " | 30.6 | 16.0 | 14.1 | 89.8 |
| 23 | Comp'n | 29.9 | 14.5 | 14.2 | 92.2 |

Table 1 illustrates examples of the alloys prepared in accordance with the present invention in terms of strength are lowered while elongation increases. In the case of Samples 8, 9 and 10, the tensile strength, yield strength and hardness increase and the elongation lowers as the addition quantity increases.

Samples 11, 12, 13 and 14 are for comparison in terms of variation in the manganese content. Sample 14 represents a comparison example. Samples 11, 12 and 13 represent the invented alloy examples. The yield strength is insufficient when the manganese is added in quantity less than the lower limit while the elongation decreases when the manganese addition exceeds the upper limit.

Samples 15, 16 and 17 are for comparison in terms of variation in the arsenic, Sample 15 representing a comparison example and Samples 16 and 17 representing the invented alloy examples. The variation in the addition quantity of arsenic does not show much difference in the mechanical properties.

Samples 18, 19 and 20 are used for comparison with respect to variation in the aluminum content, Samples 18 and 19 representing the invented alloy examples and Sample 20 a comparison example. When aluminum adddition quantity exceeds the upper limit, there appears a $\beta$ phase in the microscopic structure of the alloy though the mechanical properties of the alloy does not vary to a great extent.

Samples 21, 22 and 23 are for comparison with respect to variation in the tin content, Samples 21 and 22 representing the invented alloy examples and Sample 23 a comparison example. When the tin content exceeds the upper limit, the elongation lowers while the hardness increases.

| II. | EMBODIMENT EXAMPLES: | Sample No. 24 and 25 |
|---|---|---|
| | Comparison Examples: | Sample No. 26 and 27 |

Table 2

| Sample No. | Cu | Sn | Zn | Pb | Si | Mn | As | Al | Fe | Impurities | Tensile str'h kg/mm² | Elongation % | Yield str'h kg/mm² | Hardness HB |
|---|---|---|---|---|---|---|---|---|---|---|---|---|---|---|
| Embodiment: | | | | | | | | | | | | | | |
| 24 | Rest | 0.15 | 28.9 | 2.76 | 0.80 | 0.10 | 0.01 | 0.11 | | 0.12 | 30 | 43 | 11.0 | 76.2 |
| 25 | " | 0.56 | 26.9 | 2.85 | 0.46 | 1.90 | 0.01 | 0.10 | | 0.09 | 32.7 | 18 | 13.5 | 89.8 |
| Comp'n equ't to Class 6 JIS bronze cast'g | | | | | | | | | | | | | | |
| 26 | Rest | 4.7 | 4.7 | 4.9 | | | | | 0.02 | 0.3 | 24.0 | 26 | 11.0 | 47.5 |
| 27 | " | 4.8 | 4.6 | 5.3 | | | | | 0.08 | 0.2 | 26.3 | 31 | 11.9 | 50.3 |

Table 2 illustrates examples of the alloys prepared in accordance with the present invention in comparison with the alloys which are equivalent to Class b 6, JIS bronze casting. The samples were prepared in the form of JIS B test pieces at a casting temperature of 1060° C. and also in the form of JIS A test pieces at another casting temperature of 1180° C. These test pieces were then machined into No. 4 test pieces respectively. The mechanical properties of these samples were compared.

Compared with the comparison alloy examples, the invented alloys excel in the tensile strength and hardness; their yield strength is about equal; and the elongation of the invented alloys varies with chemical composition.

| III. | EMBODIMENT EXAMPLES: | Sample No. 28, 32 and 33 |
|---|---|---|
| | Comparison Examples: | Sample No. 29, 30 and 31 |

Table 3

| Sample No. | Chemical component, wt % | | | | | | | | | Mechanical properties | | | |
|---|---|---|---|---|---|---|---|---|---|---|---|---|---|
| | Cu | Zn | Pb | Si | Mn | As | Al | Fe | Impurities | Tensile str'h kg/mm² | Elongation % | Yield str'h kg/mm² | Hardness HB |
| Embod't: | | | | | | | | | | | | | |
| 28 | rest | 31.3 | 1.30 | 0.80 | 1.30 | 0.04 | 0.05 | | 0.09 | 34.7 | 16.7 | 21.3 | 86.6 |
| Comp'n | | | | | | | | | | | | | |
| 29 | 85.43 | 4.27 | 5.05 | (Sn) 4.75 | | | | | 0.20 | 23.0 | 10.0 | 29.0 | 64.0 |
| 30 | 59.47 | 38.26 | 1.60 | | | | | | 0.67 | 54.0 | 29.0 | 23.0 | 121 |
| 31 | 58.85 | 37.66 | | (Sn) 0.58 | 0.65 | | 1.05 | 0.56 | 0.65 | 58.0 | 27.0 | 30.0 | 135 |
| Embod't | | | | | | | | | | | | | |
| 32 | est | 28.9 | 2.85 | 0.46 | 1.90 | | 0.10 | (Sn) 0.56 | 0.15 | 32.7 | 13.5 | 18.0 | 89.8 |
| 33 | " | 28.9 | 2.76 | 0.80 | | | 0.10 | (Sn) 0.15 | 0.12 | 28.7 | 11.0 | 29.5 | 72.4 |

| Sample No. | Impact resistance value, kg-m/cm² | | | | | |
|---|---|---|---|---|---|---|
| | −75° C | −30° C | 20° C | 100° C | 200° C | 300° C |
| Embodiment example: | | | | | | |
| 28 | 4.05 | 4.28 | 4.50 | 4.39 | 3.82 | 3.56 |
| Comparison example: | | | | | | |
| 29 | 2.0 | 2.0 | 2.5 | 2.5 | 2.5 | 1.3 |
| 30 | 3.2 | 3.6 | 3.5 | 3.5 | 3.2 | 1.6 |
| 31 | 5.5 | 5.5 | 5.5 | 5.0 | 4.8 | 2.5 |
| Embodiment example: | | | | | | |
| 32 | 3.20 | 3.40 | 3.49 | 3.13 | 3.01 | 2.32 |
| 33 | 5.52 | 5.36 | 5.68 | 5.28 | 4.42 | 4.12 |

Table 3 together with the accompanying drawing shows impact resistance comparison of the invented alloys with an alloy which is equivalent to Class 6 of JIS bronze casting, a forging brass rod and a high strength brass. These samples were prepared into JIS No. 3 test pieces with Charpy U notches and their impace resistance values were measured at various temperatures.

Compared with the alloy equivalent to Class 6 bronze casting, forging brass rod and high strength brass, the impact resistance of the invented alloys indicates less decrease than these comparison alloys with temperature increased up to 300° C.

| | |
|---|---|
| IV. EMBODIMENT EXAMPLES: | Sample No. 34, 35, 36, 37,38 and 39 |
| Comparison Examples: | Sample No. 40, 41 and 42 |

Table 4

| Sample No. | Chemical components, wt % Cu | Zn | Pb | Si | Mn | As | Al | Sn | Mechanical properties Tensile str'h kg/mm² | Elongation % | Yield str'h kg/mm² | Hardness HB |
|---|---|---|---|---|---|---|---|---|---|---|---|---|
| 34 | Rest | 30.96 | 2.45 | 0.47 | 1.68 | 0.063 | 0.14 | | 32.0 | 23.0 | 13.6 | 80.4 |
| 35 | " | 27.80 | 2.07 | 0.41 | 1.86 | 0.10 | 0.31 | | 32.3 | 23.0 | 14.1 | 82.6 |
| 36 | " | 32.00 | 1.00 | 0.37 | 0.94 | 0.10 | 0.33 | | 33.6 | 25.0 | 14.3 | 83.7 |
| 37 | " | 30.62 | 3.04 | 0.37 | 0.90 | 0.10 | 0.33 | | 34.1 | 28.0 | 14.5 | 78.2 |
| 38 | " | 30.12 | 2.48 | 0.46 | 2.00 | 0.01 | 0.33 | 0.23 | 30.9 | 19.0 | 14.2 | 83.6 |
| 39 | " | 30.35 | 2.48 | 0.46 | 2.00 | 0.01 | 0.33 | 0.61 | 30.6 | 16.0 | 14.1 | 89.5 |
| 40 HBsB | 57.21 | Rest | 1.40 | (Fe) 0.20 | 0.65 | (Ni) — | 0.58 | 0.24 | 57.6 | 24.4 | | |
| 41 BsBF | 59.05 | " | 1.40 | (Fe) 0.23 | | | | 0.56 | 42.5 | 35.0 | | |
| 42 BC-6 | 83.4 | 5.40 | 5.70 | — | — | — | — | 5.30 | 24.3 | 26.0 | 11.0 | |

| Sample No. | Degree of Corrosion: Corrosion mg/cm²/month | Erosion mm/month | Dezincing depth mm/month | Total erosion depth mm/month |
|---|---|---|---|---|
| 34 | 8.743 | 0.011 | — | 0.011 |
| 35 | 14.374 | 0.017 | — | 0.017 |
| 36 | 12.805 | 0.015 | — | 0.015 |
| 37 | 12.378 | 0.015 | — | 0.015 |
| 38 | 11.890 | 0.014 | — | 0.014 |
| 39 | 12.500 | 0.015 | — | 0.015 |
| 40 HBsB | 7.763 | 0.009 | 0.050 | 0.054 |
| 41 BsBF | 1.228 | 0.009 | 0.040 | 0.051 |
| 42 BC-6 | 2.808 | 0.010 | — | 0.010 |

Referring to Table 4 above, the invented alloys, an alloy which is equivalent to Class 6 of JIS bronze casting, a forging brass rod and a high strength brass were machined into test pieces each measuring 14 mm in dia. and 32 mm in length. They were immersed in a corrosive liquid (normal temperature, stationary) which had been adjusted to PH 3 and decrease in quantity of each sample due to corrosion was examined. Table 4 shows the test results thus obtained. The corrosion is expressed in mg/cm²/month and erosion in mm/month. Compared with the other alloys, the invented alloy examples did not show any dezincing, in the same manner as the alloy equivalent to Class 6 alloy of JIS bronze casting, and had a very little total erosion depth showing excellent corrosion resitance.

| | |
|---|---|
| V. EMBODIMENT EXAMPLE: | Sample No. 46 |

-continued

| | |
|---|---|
| Comparison Examples: | Sample No. 43, 44 and 45 |

Table 5

| Alloy sample No. | Chemical component, wt % Cu | Sn | Zn | Pb | | | Comparison of machinability |
|---|---|---|---|---|---|---|---|
| 43 BsBM, free cutting brass | 61.5 | | 35.5 | 3.0 | | | 100 |
| | | | | (Al) | (Fe) | (Mn) | |
| 44 HBsB, high strength brass | 57.3 | | Rest | 0.6 | 0.3 | 0.8 | 20 |
| 45 BC-6, Class 6 bronze cast'g | 88.9 | 4.3 | 6.0 | 5.50 | | | 90 |
| | | | | | (Si) | (Mn) | |
| 46 Alloy of this invention | Rest | | 28.9 | 2.85 | 0.46 | 1.90 | 90 |

Table 5 shows the machinability of the alloy of this invention in comparison with a free cutting brass rod and other alloys. Compared with other alloys, the invented alloy shows excellent machinability.

Compared with other alloys, as shown in Tables 1 through 5 and in the accompanying drawing, the alloys prepared in accordance with this invention excels in mechanical properties, corrosion resistance and machinability. The invented alloys also excels in castability and thus permit the manufacture of castings in complex shapes. Furthermore, compared with other corrosion resistant copper alloys, the invented alloys greatly excel in the yield rate and also in forgeability. Therefore, the invented alloys are highly suitable also for the manufacture of forged products of complex shapes.

As described in the foregoing, the alloys of the present invention are great improvements over the conventional corrosion resisting copper alloys and can be advantageously applied to industrial purposes.

What is claimed is:

1. A copper alloy which is composed of 27.0–32.0 wt % zinc, 0.8–4.0 wt % lead, 0.2–0.8 wt % silicon, 0.1–2.0 wt % manganese, 0.01–0.1 wt % arsenic, 0.03–0.4 wt % aluminum, 0.01–1.0 wt % tin, the remainder being copper.

2. The copper alloy of claim 1 wherein the aluminum is present in an amount of 0.03–0.35 wt %.

3. The copper alloy of claim 1 wherein the silicon is present in an amount of 0.2–0.47 wt %.

* * * * *